US005822901A

United States Patent [19]

Fang

[11] Patent Number: 5,822,901

[45] Date of Patent: Oct. 20, 1998

[54] PICTURE DISPLAY ASSEMBLY

[76] Inventor: Yu-Jung Fang, 58, Ma Yuan West St., Taichung, Taiwan

[21] Appl. No.: 910,586

[22] Filed: Jul. 26, 1997

[51] Int. Cl.[6] ..... G09F 11/00; G09F 11/30

[52] U.S. Cl. ..... 40/476; 40/508; 40/511

[58] Field of Search ..... 40/476, 489, 508, 40/509, 511, 513

[56] References Cited

U.S. PATENT DOCUMENTS

| | | | |
|---|---|---|---|
| 1,543,852 | 6/1925 | Hanscom | 40/476 |
| 2,122,250 | 6/1938 | Godoy | 40/476 |
| 3,568,345 | 3/1971 | Grosse | 40/476 |

*Primary Examiner*—Kenneth J. Dorner
*Assistant Examiner*—Robert G. Santos

[57] ABSTRACT

A picture display assembly has a hollow base seat, a main frame coupling with the hollow base seat, a transparent plate covering a front face of the main frame, a rear plate covering a rear face of the main frame, a separation plate disposed in a front interior of the main frame, a display chamber defined between the transparent plate and the separation plate, an elastic plate disposed in a rear interior of the main frame, a storage chamber defined between the separation plate and the elastic plate, an upper plate disposed in an upper interior of the main frame, a slit defined between the separation plate and the upper plate, a switch plate disposed on an upper end of the upper plate, a swivel button disposed on an end of the switch plate, a rolling device disposed in a top interior of the main frame, and a roller set disposed in a middle interior of the main frame.

4 Claims, 8 Drawing Sheets

PICTURE DISPLAY ASSEMBLY

BACKGROUND OF THE INVENTION

The present invention relates to a picture display assembly. More particularly, the present invention relates to a picture display assembly which can switch and display pictures.

A conventional picture display device can display a single picture or photograph only. Since the function of a conventional picture frame remains as the original designs, the conventional picture frame cannot display a plurality of pictures simultaneously. The conventional photograph frame cannot display a plurality of photographs, either. Therefore, the user has to detach an original picture or photograph first, and replace a new picture or photograph later.

SUMMARY OF THE INVENTION

An object of the present invention is to provide a picture display assembly which can display pictures or photographs.

Another object of the present invention is to provide a picture display assembly which can switch pictures or photographs.

Another object of the present invention is to provide a picture display assembly which can display a plurality of pictures or photographs according to the operation of the user.

Accordingly, a picture display assembly comprises a hollow base seat, a main frame coupling with the hollow base seat, a transparent plate covering a front face of the main frame, a rear plate covering a rear face of the main frame, a separation plate disposed in a front interior of the main frame, a display chamber defined between the transparent plate and the separation plate, an elastic plate disposed in a rear interior of the main frame, a storage chamber defined between the separation plate and the elastic plate, an upper plate disposed in an upper interior of the main frame, a slit defined between the separation plate and the upper plate, a switch plate disposed on an upper end of the upper plate, a swivel button disposed on an end of the switch plate, a rolling device disposed in a top interior of the main frame, and a roller set disposed in a middle interior of the main frame. The rolling device has a rolling cylinder, a volute spring disposed on a first end of the rolling cylinder, an axle gear disposed on a second end of the rolling cylinder, and a transmission gear disposed on the second end of the rolling cylinder and engaging with the axle gear. The roller set has a first roller passing through the main frame, a second roller passing through the main frame and parallel to the first roller, and a belt surrounding a first end of the first roller and a first end of the second roller. A shaft gear is disposed on a second end of the first roller. The first roller and the second roller clamp a plurality of pictures. The hollow base seat has a base plate, a U-shaped frame disposed on the base plate, and a post disposed on the U-shaped frame. The post has an upper serrated portion engaging with the shaft gear. The storage chamber receives a plurality of pictures which are arranged in series. When the upper serrated portion of the post engages with the shaft gear, the shaft gear rotates counterclockwisely. The first roller rotates counterclockwisely and drives the second roller to rotate counterclockwisely via the belt. The first roller pushes a first picture to move upward via the slit and the switch plate. The first picture is placed between the switch plate and the rolling cylinder. When the disk is pressed downward, the rolling cylinder rotates clockwisely. Then the volute spring is wound, and the first picture does not move. When the disk is released, the volute spring recovers to an original state and drives the rolling cylinder to rotate counterclockwisely. The first picture enters the display chamber via the rolling cylinder.

DETAILED DESCRIPTION OF THE INVENTION

Figure 1:
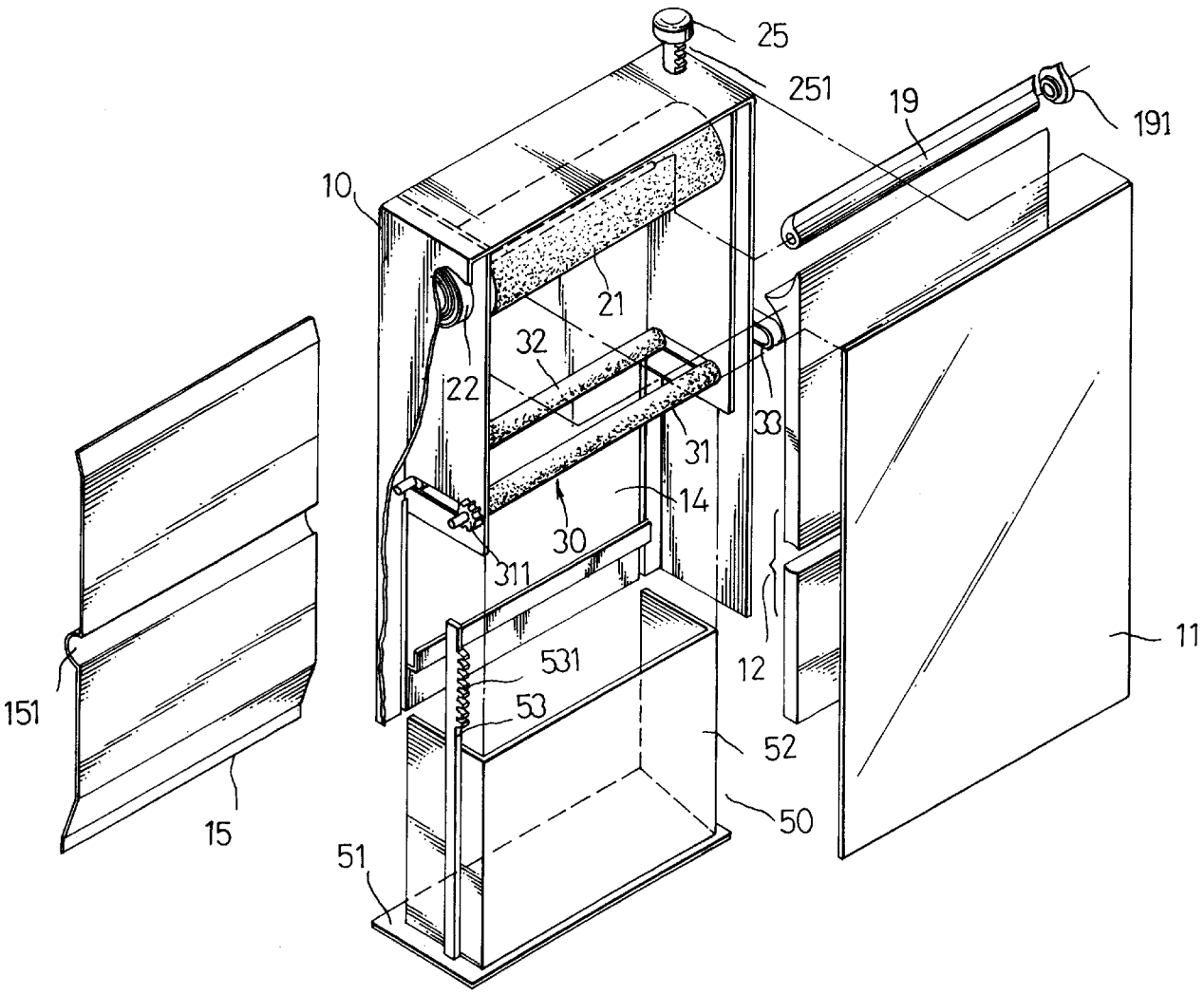
FIG. 1 is a perspective exploded view of a picture display assembly of a preferred embodiment in accordance with the present invention.
Figure 2:
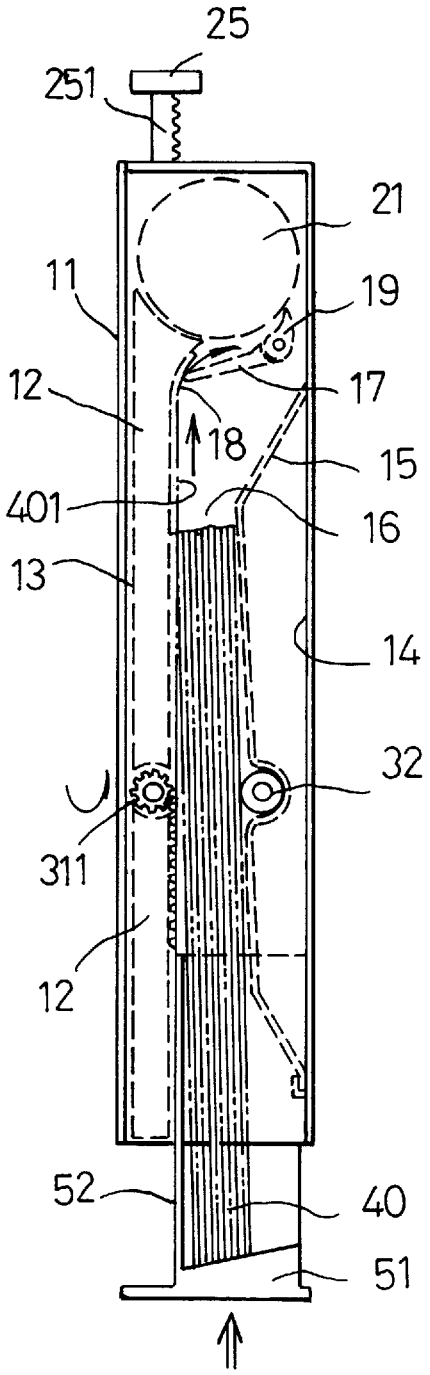
FIG. 2 is a structural schematic view of FIG. 1.
Figure 3:
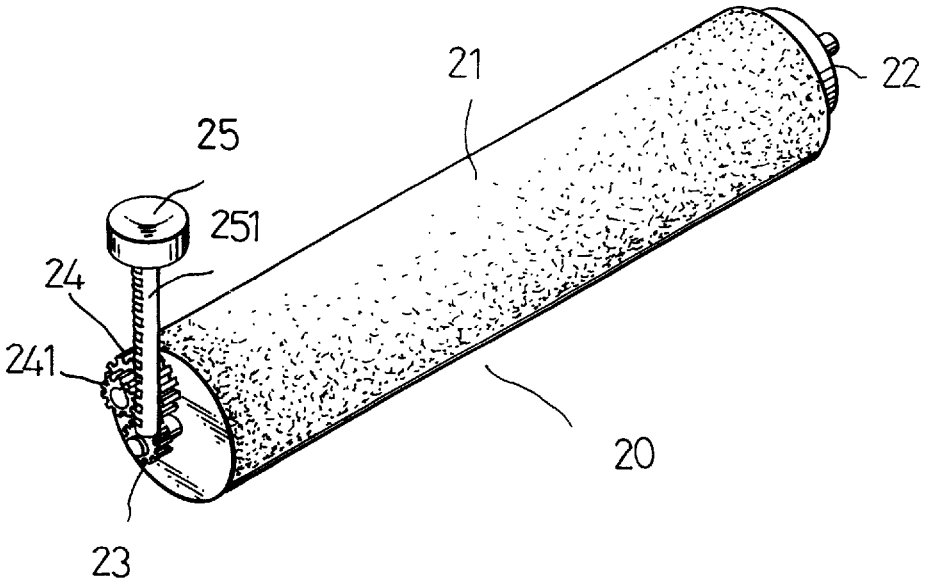
FIG. 3 is a perspective view of a rolling device of a preferred embodiment in accordance with the present invention.
Figure 4:
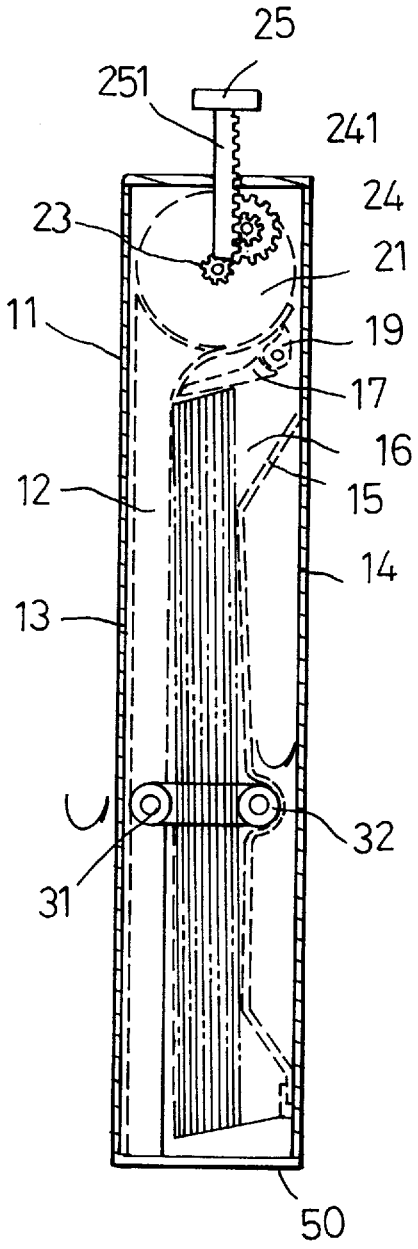
FIG. 4 is another structural schematic view of FIG. 1.

Referring to FIGS. 1 to 4, a picture display assembly comprises a hollow base seat 50, a main frame 10 coupling with the hollow base seat 50, a transparent plate 11 covering a front face of the main frame 10, a rear plate 14 covering a rear face of the main frame 10, a separation plate 12 disposed in a front interior of the main frame 10, a display chamber 13 defined between the transparent plate 11 and the separation plate 12, an elastic plate 15 disposed in a rear interior of the main frame 10, a storage chamber 16 defined between the separation plate 12 and the elastic plate 15, an upper plate 17 disposed in an upper interior of the main frame 10, a slit 18 defined between the separation plate 12 and the upper plate 17 to receive a single picture 40, a switch plate 19 disposed on an upper end of the upper plate 17, a swivel button 191 disposed on an end of the switch plate 19, a rolling device 20 disposed in a top interior of the main frame 10, and a roller set 30 disposed in a middle interior of the main frame 10. The rolling device 20 has a rolling cylinder 21, a volute spring 22 disposed on a first end of the rolling cylinder 21, an axle gear 23 disposed on a second end of the rolling cylinder 21, a transmission gear 24 disposed on the second end of the rolling cylinder 21 and engaging with the axle gear 23, a pinion 241 disposed on the transmission gear 24, a rack 251 disposed on the axle gear 23, an upper portion of the rack 251 passing through a top portion of the main frame 10, and a disk 25 disposed on an upper end of the rack 251. The rack 251 engages with the pinion 241. The roller set 30 has a first roller 31 passing through the main frame 10, a second roller 32 passing through the main frame 10 and parallel to the first roller 31, and a belt 33 surrounding a first end of the first roller 31 and a first end of the second roller 32. A shaft gear 311 is disposed on a second end of the first roller 31. The first roller 31 and the second roller 32 clamp a plurality of pictures 40. The hollow base seat 50 has a base plate 51, a U-shaped frame 52 disposed on the base plate 51, and a post 53 disposed on the U-shaped frame 52. The post 53 has an upper serrated portion 531 engaging with the shaft gear 311. The storage chamber 16 receives a plurality of pictures 40 which are arranged in series.

When the upper serrated portion 531 of the post 53 engages with the shaft gear 311, the shaft gear 311 rotates counterclockwisely. The first roller 31 rotates counterclockwisely and drives the second roller 32 to rotate counterclockwisely via the belt 33. The first roller 31 pushes a first picture 401 to move upward via the slit 18 and the switch plate 19. The first picture 401 is placed between the switch plate 19 and the rolling cylinder 21.

Figure 5:
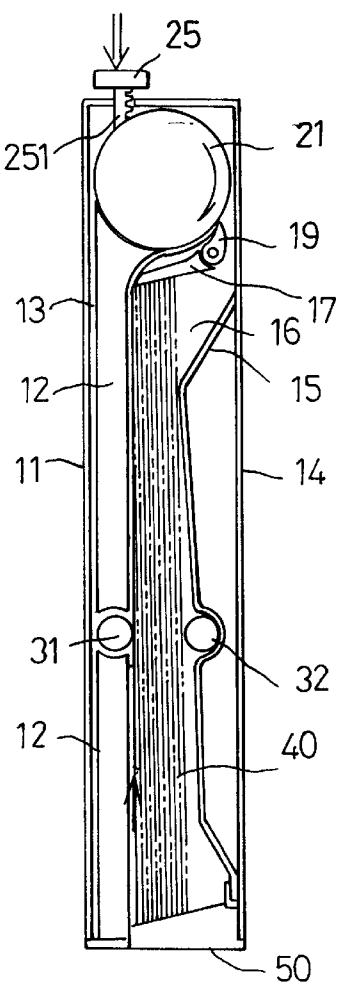
FIGS. 5, 5A and 5B are schematic views illustrating operations of a preferred embodiment in accordance with the present invention.
Figure 5A:
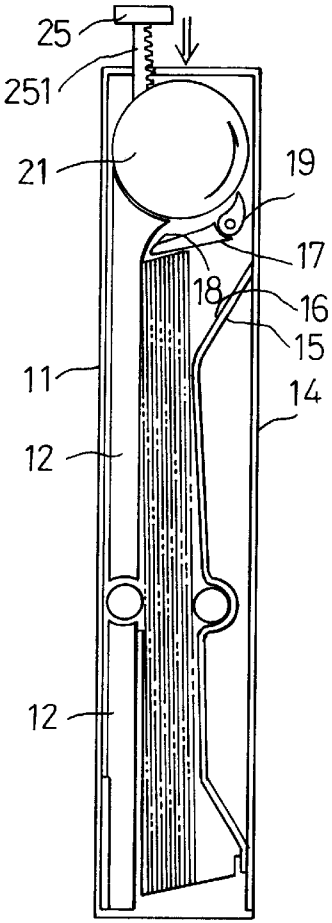
Figure 5B:
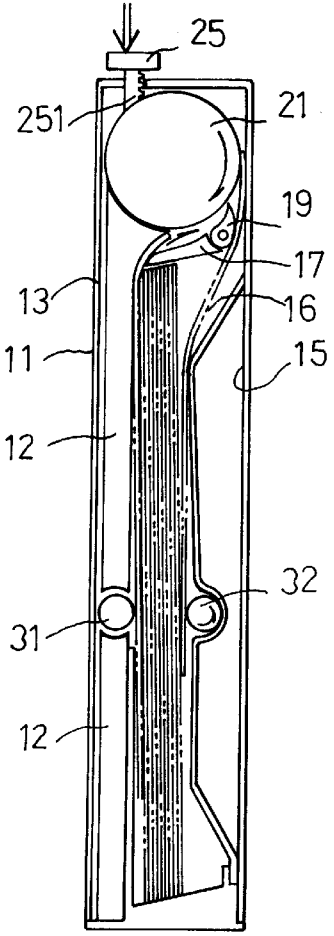

Referring to FIG. 5, the disk 25 is pressed downward to drive the rolling cylinder 21 to rotate clockwisely. The volute spring 22 is wound, and the first picture 401 does not move. When the disk 25 is released, the volute spring 22 recovers to an original state and drives the rolling cylinder 21 to rotate counterclockwisely (as shown in FIG. 5A). The first picture 401 enters the display chamber 13 via the rolling cylinder 21. When the disk 25 is pressed downward again, the rolling cylinder 21 rotates clockwisely. The first picture 401 is sent back to the storage chamber 16 via the rolling cylinder 21 (as shown in FIG. 5B). When the first picture 401 passes through the second roller 32, the first picture 401 drives the second roller 32 to rotate counterclockwisely. Thus the first roller 31 is driven to rotate counterclockwisely via the belt 33. The first roller 31 pushes a second picture 401 to move upward via the slit 18 and the switch plate 19. The second picture 401 is placed between the switch plate 19 and the rolling cylinder 21. The disk 25 is pressed downward again to drive the rolling cylinder 21 to rotate clockwisely. The volute spring 22 is wound, and the second picture 401 does not move. When the disk 25 is released, the volute spring 22 recovers to an original state and drives the rolling cylinder 21 to rotate counterclockwisely. The second picture 401 enters the display chamber 13 via the rolling cylinder 21. When the disk 25 is pressed downward again, the rolling cylinder 21 rotates clockwisely. The second picture 401 is sent back to the storage chamber 16 via the rolling cylinder 21.

Figure 6A:
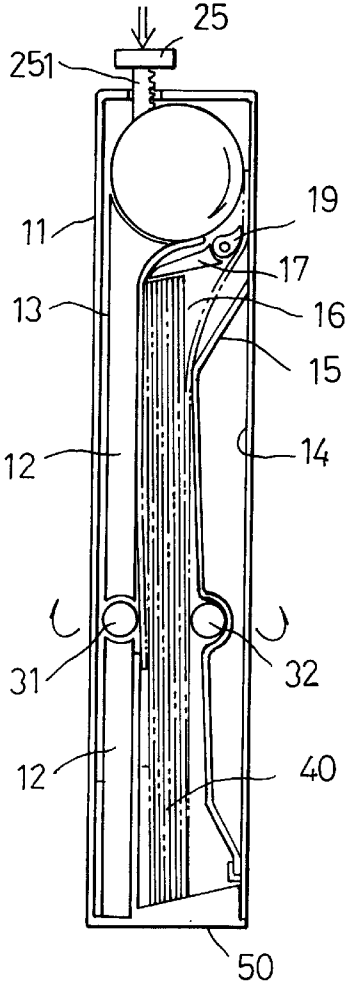
FIGS. 6 and 6A are schematic views illustrating operations of a preferred embodiment in accordance with the present invention.
Figure 6:
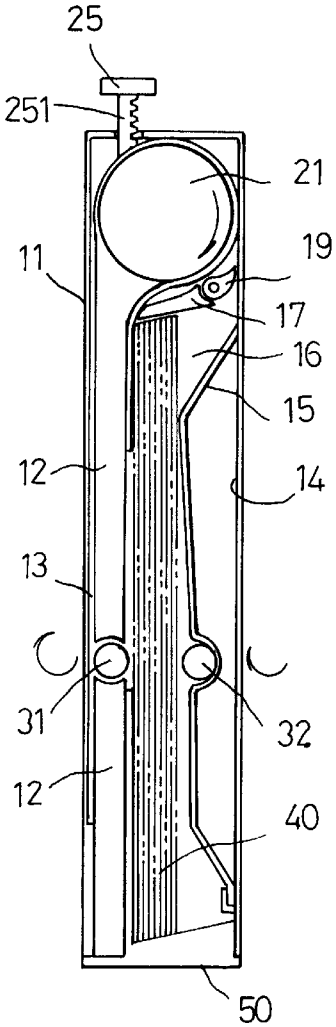

Referring to FIG. 6, the swivel button 191 is rotated to switch the switch plate 19 toward the rear plate 14. The disk 25 is pressed downward to drive the rolling cylinder 21 to rotate clockwisely. The volute spring 22 is wound. The first picture 401 or the second picture 401 is sent back to the storage chamber 16. When the first picture 401 or the second picture 401 passes through the first roller 31, the first roller 31 rotates clockwisely. Then the second roller 32 rotates clockwisely also. The last picture 401 moves upward via the switch plate 19 (as shown in FIG. 6A). When the disk 25 is released, the volute spring 22 recovers to an original state and drives the rolling cylinder 21 to rotate counterclockwisely. The last picture 401 enters the display chamber 13 via the rolling cylinder 21.

Figure 7:
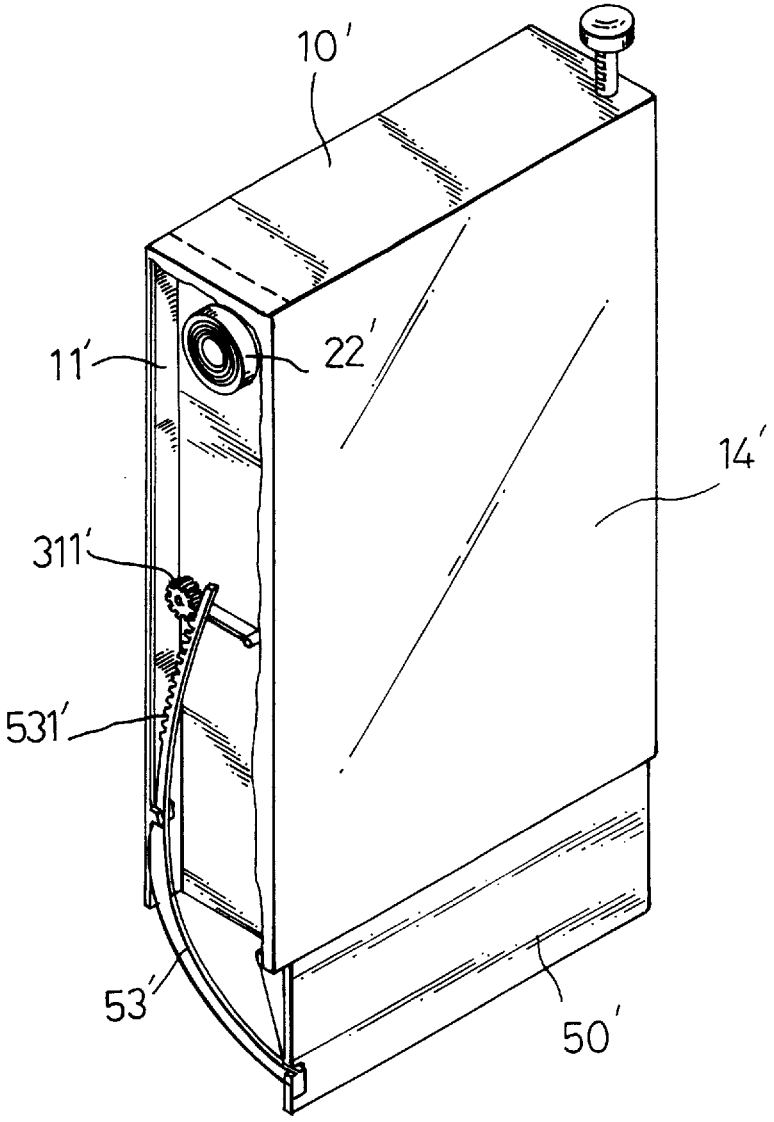
FIG. 7 is a perspective assembly view of a picture display assembly of another preferred embodiment in accordance with the present invention.

Referring to FIG. 7, another picture display assembly comprises a hollow base seat 50', a main frame 10' coupling with the hollow base seat 50', a transparent plate 11' covering a front face of the main frame 10', a rear plate 14' covering a rear face of the main frame 10', a rolling cylinder (not shown in the figures) disposed in a top interior of the main frame 10', a volute spring 22' disposed on a first end of the rolling cylinder, a roller set (not shown in the figures) has a first roller passing through the main frame 10', a second roller passing through the main frame 10' and parallel to the first roller, and a belt surrounding a first end of the first roller and a first end of the second roller. A shaft gear 311' is disposed on a second end of the first roller. The hollow base seat 50' has a curved post 53'. A lower end of the curved post 53' is disposed on the hollow base seat 50'. The curved post 53' has an upper serrated portion 531' engaging with the shaft gear 311'.

Figure 8:
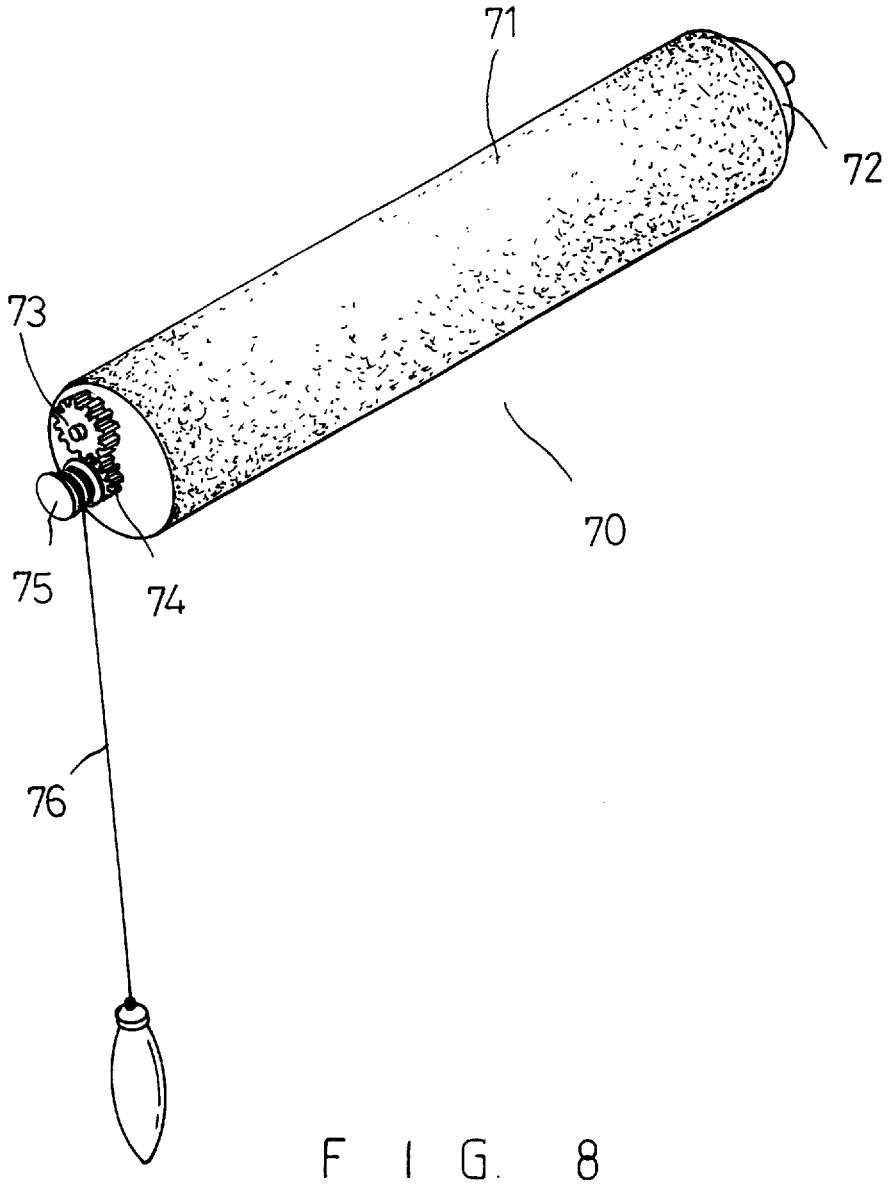
FIG. 8 is a perspective view of a rolling device of another preferred embodiment in accordance with the present invention.

Referring to FIG. 8, another rolling device 70 has a rolling cylinder 71, a volute spring 72 disposed on a first end of the rolling cylinder 71, an axle gear 74 disposed on a second end of the rolling cylinder 71, a transmission gear 73 disposed on the second end of the rolling cylinder 71 and engaging with the axle gear 74, a pulley 75 disposed on the axle gear 74, and a rope 76 surrounding the pulley 75.

Therefore, the picture display assembly can switch and display pictures from the first picture to the last picture in order. Alternatively, the picture display assembly can switch and display pictures from the last picture to the first picture in order.

The invention is not limited to the above embodiment but various modification thereof may be made. Further, various changes in form and detail may be made without departing from the scope of the invention.

I claim:

1. A picture display assembly comprises:

a hollow base seat, a main frame coupling with the hollow base seat, a transparent plate covering a front face of the main frame, a rear plate covering a rear face of the main frame, a separation plate disposed in a front interior of the main frame, a display chamber defined between the transparent plate and the separation plate, an elastic plate disposed in a rear interior of the main frame, a storage chamber defined between the separation plate and the elastic plate, an upper plate disposed in an upper interior of the main frame, a slit defined between the separation plate and the upper plate, a switch plate disposed on an upper end of the upper plate, a swivel button disposed on an end of the switch plate, a rolling device disposed in a top interior of the main frame, a roller set disposed in a middle interior of the main frame, the rolling device having a rolling cylinder, a volute spring disposed on a first end of the rolling cylinder, an axle gear disposed on a second end of the rolling cylinder, and a transmission gear disposed on the second end of the rolling cylinder and engaging with the axle gear, the roller set having a first roller passing through the main frame, a second roller passing through the main frame and parallel to the first roller, and a belt surrounding a first end of the first roller and a first end of the second roller, a shaft gear disposed on a second end of the first roller, the hollow base seat having a base plate, a U-shaped frame disposed on the base plate, and a post disposed on the U-shaped frame, and the post having an upper serrated portion engaging with the shaft gear.

2. A picture display assembly as claimed in claim 1, wherein a transmission gear is disposed on the second end of the rolling cylinder and engaging with the axle gear, a pinion is disposed on the transmission gear, a rack is disposed on the axle gear, an upper portion of the rack passes through a top portion of the main frame, a disk is disposed on an upper end of the rack, and the rack engages with the pinion.

3. A picture display assembly as claimed in claim 1, wherein a pulley is disposed on the axle gear and a rope surrounding the pulley.

4. A picture display assembly as claimed in claim 1, wherein the post is in a curved shape.

* * * * *